US008303396B2

(12) United States Patent
Kananen

(10) Patent No.: US 8,303,396 B2
(45) Date of Patent: Nov. 6, 2012

(54) METHOD OF ARRANGING LOTTERY GAMES, GAME SERVER, DATA TRANSMISSION SYSTEM AND COMPUTER PROGRAM PRODUCT

(75) Inventor: Atte Kananen, Kuusamo (FI)

(73) Assignee: AXO-Service Oy, Kuusamo (FI)

( * ) Notice: Subject to any disclaimer, the term of this patent is extended or adjusted under 35 U.S.C. 154(b) by 951 days.

(21) Appl. No.: 12/085,045

(22) PCT Filed: Nov. 14, 2006

(86) PCT No.: PCT/FI2006/050494

§ 371 (c)(1),
(2), (4) Date: Jun. 24, 2008

(87) PCT Pub. No.: WO2007/057515

PCT Pub. Date: May 24, 2007

(65) Prior Publication Data

US 2009/0170587 A1 Jul. 2, 2009

(30) Foreign Application Priority Data

Nov. 17, 2005 (FI) ..... 20055611

(51) Int. Cl.
*A63F 9/24* (2006.01)

(52) U.S. Cl. ..... 463/17; 463/25

(58) Field of Classification Search ..... 463/16–20, 463/25

See application file for complete search history.

(56) References Cited

U.S. PATENT DOCUMENTS 6,347,996 B1 * 2/2002 Gilmore et al. ..... 463/17

(Continued)

FOREIGN PATENT DOCUMENTS

EP 1 063 622 A2 12/2000

(Continued)

OTHER PUBLICATIONS www.mine-sweeper.com, julkinen Nov. 21, 2004 (http://web.archive.org/web/*/http://www.mine-sweeper.com/) koko dokumentti.

*Primary Examiner* — Peter DungBa Vo
*Assistant Examiner* — Steve Rowland
(74) *Attorney, Agent, or Firm* — Birch, Stewart, Kolasch & Birch, LLP

(57) ABSTRACT

A lottery game server comprising: a processing unit for controlling the functions of the server; a data transmission unit coupled to the processing unit for communicating with a game terminal; and a memory unit coupled to the processing unit for storing a game board and winning conditions relating to the game board; the processing unit comprises a loading module for loading the game board into the game terminal for playing a lottery game, a selection module for receiving a game selection relating to the game board from the game terminal via the data transmission unit, a comparison module for comparing the game selection with the winning conditions relating to the game board, and a result module for generating a game result on the basis of the comparison conducted. The processing unit further comprises a continuation module for modifying the game board on the basis of the game result and predetermined rules in such a manner that selections made in the game board are deleted from the selection of the game board, and for generating continuation winning conditions relating to the game board on the basis of the game result and the predetermined rules; and the selection module further receives a continuation selection relating to the game board from the game terminal via the data transmission unit; the comparison module further compares the continuation selection with the continuation winning conditions; and the result module further generates a continued game result on the basis of the comparison conducted.

23 Claims, 5 Drawing Sheets

U.S. PATENT DOCUMENTS

| | | | | |
|---|---|---|---|---|
| 6,439,995 | B1 * | 8/2002 | Hughs-Baird et al. | 463/20 |
| 6,632,141 | B2 * | 10/2003 | Webb et al. | 463/25 |
| 2002/0142822 | A1 * | 10/2002 | Baerlocher et al. | 463/16 |
| 2002/0183108 | A1 | 12/2002 | Baeg | |
| 2003/0017867 | A1 | 1/2003 | deKeller | |
| 2003/0119580 | A1 * | 6/2003 | McClintic et al. | 463/25 |
| 2004/0023707 | A1 * | 2/2004 | Maya et al. | 463/16 |
| 2004/0209662 | A1 * | 10/2004 | Wadleigh | 463/16 |
| 2005/0056999 | A1 * | 3/2005 | Roemer et al. | 273/273 |
| 2005/0107153 | A1 | 5/2005 | Jubinville et al. | |
| 2005/0153767 | A1 * | 7/2005 | Gauselmann | 463/16 |
| 2006/0151943 | A1 | 7/2006 | Bozeman | |
| 2007/0010319 | A1 | 1/2007 | Lind et al. | |

FOREIGN PATENT DOCUMENTS

| | | | |
|---|---|---|---|
| WO | WO-99/42964 | A1 | 8/1999 |
| WO | WO-01/75825 | A2 | 10/2001 |

* cited by examiner

METHOD OF ARRANGING LOTTERY GAMES, GAME SERVER, DATA TRANSMISSION SYSTEM AND COMPUTER PROGRAM PRODUCT

FIELD

The invention relates to a method of arranging lottery games, a game server, a data transmission system and a computer program product.

BACKGROUND

Various lottery games played over a data transmission network, such as the Internet, are increasingly replacing conventional game forms, wherein game tokens and lottery tickets are purchased at a counter. Service providers allow their clients to access an Internet page, for example, via which the clients are able to purchase the desired games wherever and by means of any device having communications connections.

When playing lottery games, such as various lottery scratch tickets or selection games, the client purchases the desired game via the home page of the service provider, after which the game board is loaded onto the display of the terminal employed by the client, allowing the client to start playing. Once the client has completed the lottery game purchased, for instance by picking numbers from an electronic game ticket, the game is completed as far as the client is concerned. As regards various instant games played over the Internet, the service provider then transmits information to the client about any winnings for the game completed.

If the client wishes to continue playing, a new game has to be started by selecting the desired game among the selection of games offered by the service provider. However, continuous loading of new games loads the hardware resources of both the service provider and the client. For example, playing various instant games many times in succession is not sensible as regards the player, since the user's influence over the progress of the game is quite slight: once the user has paid the sum entitling to a game and made the game-related selections, the game is again over.

As online playing continues to increase via computers, multimedia devices and www televisions, for example, new user-friendly solutions are required for saving the resources of the service providers in arranging lottery games.

BRIEF DESCRIPTION

The object of the invention is to provide a method and equipment for implementing the method so as to achieve an improved method of arranging selection games in a data transmission system, an improved game server, an improved data transmission system and an improved computer program product.

This is achieved by a method of arranging lottery games, the method comprising: loading a game board into a gaming terminal for playing a lottery game; receiving a game selection relating to the game board via a data transmission unit from a game terminal; comparing the game selection with winning conditions relating to the game board; and generating a game result on the basis of the comparison conducted. The method further comprises: modifying the game board on the basis of the game result and predetermined rules in such a manner that selections already made in the game board are deleted from the selections of the game board, and generating continuation winning conditions relating to the game board on the basis of the game result and predetermined rules; receiving a continuation selection relating to the game board via the data transmission unit from the game terminal; comparing the continuation selection with the continuation winning conditions; and generating the continued game result on the basis of the comparison conducted.

The invention also relates to a lottery game server comprising a processing unit for controlling the functions of the server; a data transmission unit coupled to the processing unit for communicating with a game terminal; and a memory unit coupled to the processing unit for storing a game board and winning conditions relating to the game board; the processing unit comprises a loading module for loading the game board into the game terminal for playing a lottery game, a selection module for receiving a game selection relating to the game board from the game terminal via the data transmission unit, a comparison module for comparing the game selection with the winning conditions relating to the game board, and a result module for generating a game result on the basis of the comparison conducted. The processing unit further comprises a continuation module for modifying the game board on the basis of the game result and predetermined rules in such a manner that selections already made in the game board are deleted from the selection of the game board, and for generating continuation winning conditions relating to the game board on the basis of the game result and the predetermined rules; and the selection module further receives a continuation selection relating to the game board from the game terminal via the data transmission unit; the comparison module further compares the continuation selection with the continuation winning conditions; and the result module further generates a continued game result on the basis of the comparison conducted.

As a further aspect of the invention there is provided a computer program product for coding a computer process for arranging lottery games, the computer process comprising: loading a game board into a game terminal for playing a lottery game; receiving a game selection relating to the game board via a data transmission unit from a game terminal; comparing the game selection with winning conditions relating to the game board; and generating the game result on the basis of the comparison conducted. The computer program product further comprises: modifying the game board on the basis of the game result and predetermined rules in such a manner that selections already made in the game board are deleted from the selections of the game board, and generating continuation winning conditions relating to the game board on the basis of the game result and predetermined rules; receiving a continuation selection relating to the game board via the data transmission unit from the game terminal; comparing the continuation selection with the continuation winning conditions; and generating the continued game result on the basis of the comparison conducted.

The method and equipment according to the invention provide a plurality of advantages. Resources can be utilized more efficiently. Numerous games can be played using the same game board. A continued game can be continued from a point where the previously played lottery game ended. In addition, the method is user friendly and efficient.

LIST OF THE FIGURES

In the following, the invention will be described in more detail in connection with preferred embodiments with reference to the accompanying drawings, in which FIG. 1 is an example of a data transmission system;

DESCRIPTION OF EMBODIMENTS

Figure 1:
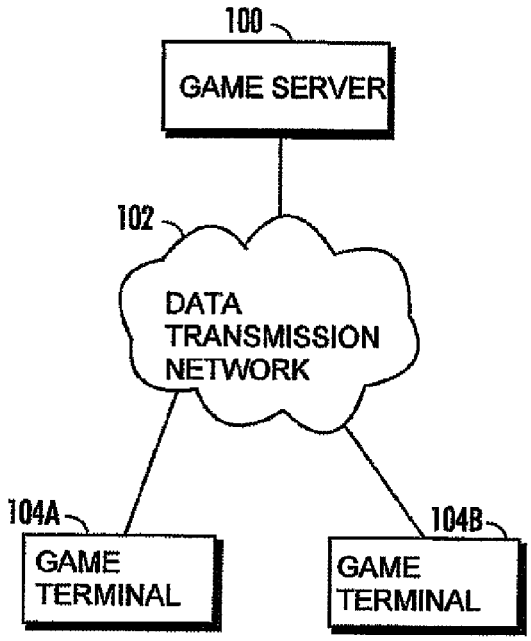

FIG. 1 shows an example of a data transmission system whereto the method described can be applied. A data transmission network 102 employed in the data transmission system can be based on the GSM (Global System for Mobile Communications), the WCDMA (Wideband Code Division Multiple Access) or the CDMA (Code Division Multiple Access) technique. The data transmission network 102 may also comprise a public telephone, cable, television or multimedia network.

A game server 100 responsible for game services communicates with game terminals 104A, 104B over the data transmission network. The game server 100 and the game terminals 104A, 104B, in turn, may communicate with the data transmission network by using fixed cable connections, GSM/GPRS/EDGE connections or short-range wireless connections, such as Bluetooth, infrared or WLAN (Wireless Local Area Network) connections, for example. It is also feasible that the game server 100 and the game terminals 104A, 104B are able to communicate with each other without the services of the actual data transmission network 102, by using short-range wireless connections, for example.

The lottery game server 100 in FIG. 1 is a Windows® computer, for example, or a computer provided with other software, which the service provider employs for providing network game services. The game server 100 comprises also a user interface, for example, for controlling the game server 100 and monitoring the actions taken by it. The embodiments described can also be implemented as a computer program product that codes a computer process for arranging network games.

The game terminals 104A, 104B are for instance personal computers, multimedia devices, telephones, televisions, PDA devices, www televisions or any other devices provided with data communication connections and usable for utilizing the services provided by the game server 100. The game terminal 104A, 104B comprises at least a processing unit for controlling the functions of the device, a data transmission unit and a user interface. The user interface may comprise a display and a keyboard, for example. Depending on the game terminal 104A, 104B, the user interface may comprise a plurality of different user interface parts. The game terminal 104A, 104B may also comprise a memory and a plurality of other elements depending on the purpose of use of the device.

Figure 2:
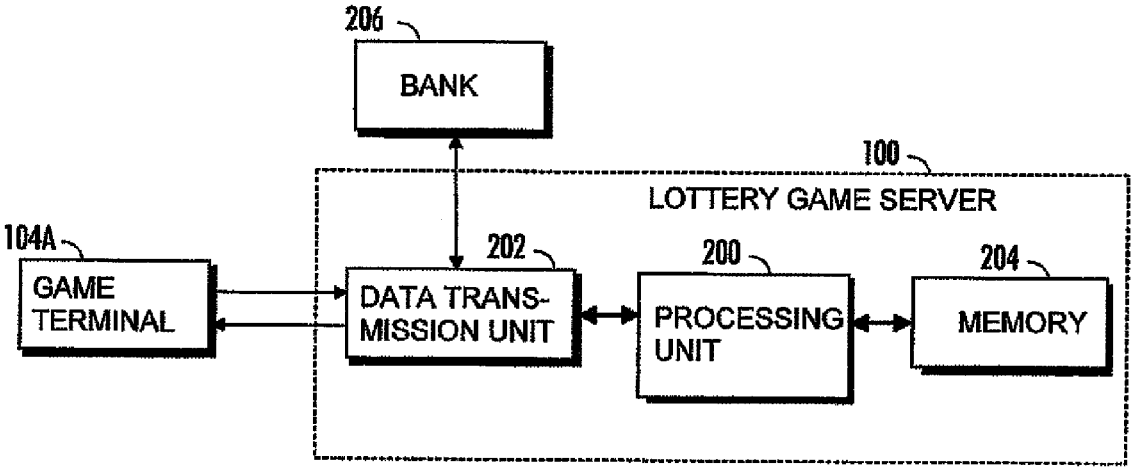
FIG. 2 is an example of a game server.

FIG. 2 is an example of a lottery game server 100. The game server comprises a processing unit 200 for controlling the functions of the device and a data transmission unit 202 coupled to the processing unit. The processing unit 200 refers to a block that controls the operation of the device and is presently usually implemented as a processor with software, but different hardware implementations are also feasible, for instance a circuit built from separate logics components or one or more application-specific integrated circuits (ASIC). A hybrid of these implementations is also feasible. The data transmission unit 202 may comprise a transceiver and an antenna, by means of which the game server 100 receives and transmits signals. The data transmission connections of the game server 100, implemented by the data transmission unit 202, may also be implemented by means of e.g. network cards, fixed or satellite connections. The game server 100 also comprises a memory unit 204, wherein data required for generating game services may be stored, such as game boards and winning conditions for the game boards. When required, the game server may communicate with a bank 206 for retrieving credit services, for example. The game server may also serve as an intermediary between the game terminal and the bank for transferring payments required for playing, for example.

The game server 100 generates lottery game services that are usable by means of the game terminal 104A. In this context, a lottery game refers to a game played by making game selections relating to a game board associated with the game at a game terminal, for example searching a grid for symbols, and by comparing the game selections made at the game server with winning conditions relating to the game for achieving a game result. Examples of lottery games are scratch cards, lotto, symbol search games (ship search), Jackpot, selection games. Herein, a lottery game may also be a purely entertaining game, wherein winning does not bring in monetary benefits and/or which can be played free of charge.

Figure 3:
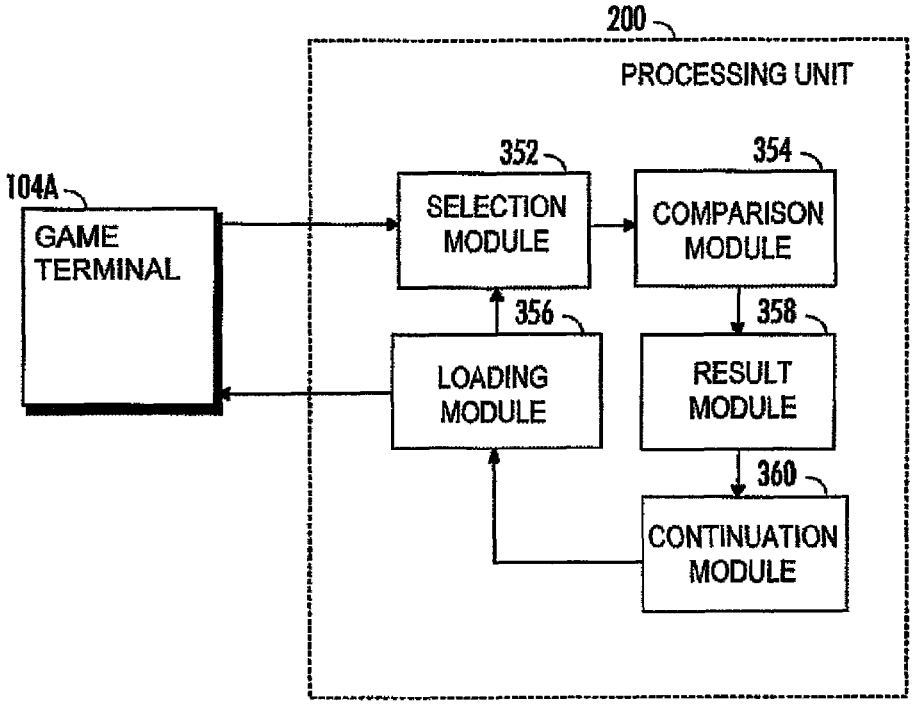
FIG. 3 shows an example of a processing unit.

FIG. 3 shows an example of a processing unit 200 in accordance with an embodiment. The processing unit 200 comprises a loading module 356 for loading a game board into a game terminal 104A for playing a lottery game. The processing unit also comprises a selection module 352 for receiving a game selection relating to the game board via a data transmission unit, a comparison module 354 for comparing the game selection with winning conditions relating to the game board, and a result module 358 for generating a game result on the basis of the comparison conducted.

In an embodiment, the processing unit 200 further comprises a continuation module 360 for modifying the game board on the basis of the game result and predetermined rules in such a manner that the selections made in the game board are deleted from the selections of the game board, and for generating continuation winning conditions relating to the game board on the basis of the game result and predetermined rules. The selection module 352 is further arranged to receive continuation selections relating to the game board via the data transmission unit from the game terminal 104A, the comparison module 354 further compares the continuation selections with the continuation winning conditions, and the result module 358 further generates a continued game result on the basis of the comparison conducted.

In an embodiment, the processing unit 200 stores the game result and/or the continued game result in a memory unit 204; and a loading module 356 loads the game board for continuing the lottery game at a later time into the same or a different game terminal wherein the game board was loaded before the continuation of the lottery game.

In an embodiment, the processing unit 200 repeats the following steps until an end condition is fulfilled: the execution of the lottery game is continued further in the same game board on the basis of the previous stored continued game result; and the next continued game result is generated on the basis of the continuation selections made and the continuation winning conditions generated. The end condition is fulfilled on the basis of the fulfillment of predetermined marginal terms, the fulfillment of time limits set, the realization of a predetermined game result and/or the number of selections in the game board to be made at each particular time.

In an embodiment, the processing unit 200 further determines the winning conditions and/or continuation winning conditions relating to the lottery game being played on the basis of the number of selections to be made in the game board. The winning conditions and/or continuation winning conditions relating to a lottery came can be determined by the use of calculus of probability, for example. The winning conditions and continuation winning conditions can be determined to be mutually different.

The game result and the continued game result may comprise one or more of the following: information on the winning sum, information on the right to continue the following lottery game based on the game result/continued game result generated, information on the prices of the lottery games that may be continued on the basis of the lottery game played; information on the winning sums, if any, of the lottery games that can be continued. The game results can be printed onto the display of the game terminal after their determination.

In an embodiment, user-identifying information is received via the data transmission unit from the game terminal, and the processing unit 200 is arranged to reserve the right to continue playing in a modified game board to given users only on the basis of the user-identifying information. It is also possible to reserve the right to continue playing in the modified game board for anybody irrespective of the user-identifying information received. For example, if a player who played a game does not immediately want to continue the game after finishing it, a game to be generated on the basis of the modified game board can be set to be selected by any player, for instance on a game list maintained by the game server. On the other hand, a player may also reserve himself the chance to continue a started game later. For example, the game server may set a time limit, within which the player, however, has to continue the game or else the game is set to be played by any player or deleted totally from the game selection.

Figure 4:
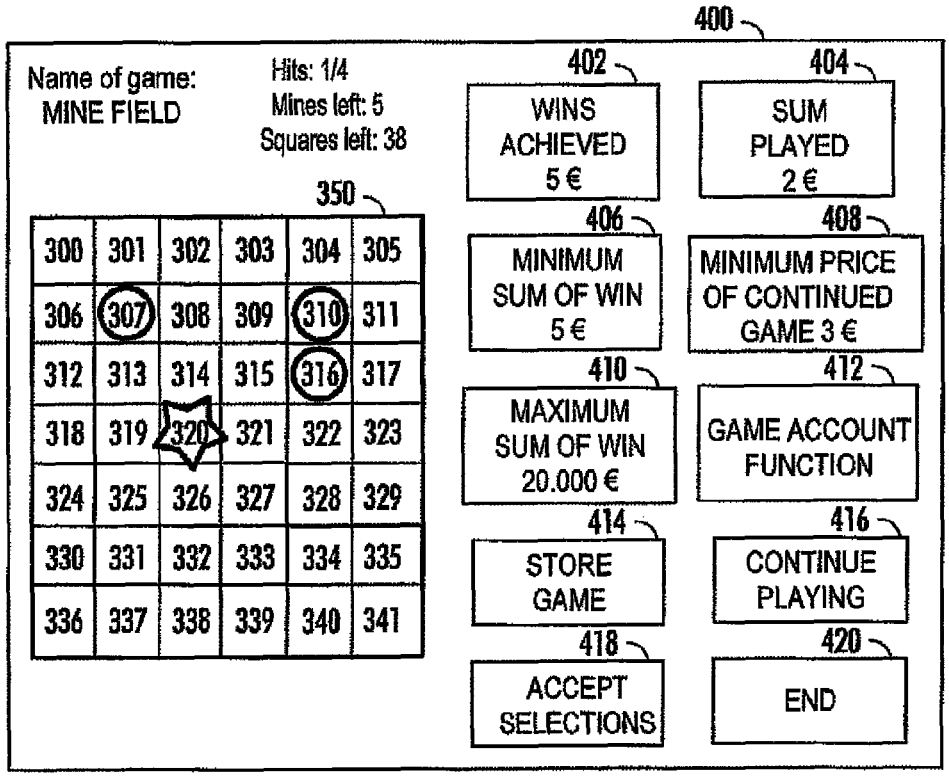
FIG. 4 illustrates an example of the user interface of a game terminal.

FIG. 4 illustrates an example of a user interface 400 of a game terminal. The user interface 400 comprises a display onto which the game server loads the desired game board 350. For example, the player has selected the desired game from a game selection via an Internet page maintained by the game server. The example used in FIG. 4 is the Minefield game. The purpose of the game is to find mines among the 42 selection fields 300 to 341 comprised by the game board 350. In the present example, there are totally five mines. The sum of the win may depend on the number of mines found and selection fields 300 to 341 cleared, for example. In the first step, different playing alternatives for playing the game may have been presented to the player, for instance the number of selection fields for whose selection the user wants to pay for. The price of the game may depend on the number of fields selected. In the present example, the player initially paid for the selection of four selection fields in the game board 350 among all the selection fields 300 to 341. The player selected selection fields 307, 310, 316 and 320. The selections made may be transferred automatically to the game server for generating the game result. The player may also first make the desired selections in the game board 350 and then accept the selections made using the 'Accept selections' button 418.

When the game server has received the selections, the game selection is compared with the winning conditions relating to the game board, and the game result is generated on the basis of the comparison conducted. In the example of FIG. 3, one out of four selections 320 hit a mine (winning hit), and the other selections 307, 310, 316 contained no win. The user interface 400 may comprise different information fields for presenting information and results included in the game. The information field 'Winnings won' 402 may display the total sum of the winnings won in the game played up to that particular moment. In the example of FIG. 4, the sum of winnings won is at present €5. The information field 'Sum played' 404 may display the sum invested in the game up to that particular moment. The information field 'Minimum sum of winning' 406 indicates the smallest possible winning in the occurrence of a hit, i.e. the finding of a mine in this case. The information field 'Minimum prize of a continued game' 408 indicates the minimum sum that the player would have to play if he continued playing in the modified game board. The information field 'Maximum sum of winning' 410 indicates the maximum sum that can be won in the game. In the example of FIG. 4, the number of hits made, the number of mines still to be found and the number of fields still to be cleared are also indicated.

The user interface 400 comprises also function keys by means of which a player may make selections relating to the game. 'Game account functions' 412 allows the player to study and manage his play accounts, to transfer winnings to a game account or to check the balance of the game account, for example. The player may store the current playing situation from the selection 'Store game' 414. The game may be stored either for all users to play or for the player himself for later playing. 'Continue playing' 416 is a selection that the player may use to select to start a continued game at the end of a previous playing step. Playing can be ended using the 'End' 420 key. The example of FIG. 4 shows a game situation, wherein the first step of the game is completed. If the player wishes to continue the game, the game server may present a plurality of alternatives to the player, among which the player selects the manner of continuing playing. Table 1 shows an example of the alternatives presented by a game sever for continuing a game.

TABLE 1

| Continued game alternatives | | | | |
|---|---|---|---|---|
| Continued game | Fields to be cleared (No.) | Payment to be made | Maximum sum of winning | Minimum sum of winning |
| 1 | 1 | 3 | 200 | 200 |
| 2 | 2 | 5 | 4,000 | 100 |
| 3 | 3 | 7 | 8,000 | 50 |
| 4 | 4 | 10 | 20,000 | 30 |
| 5 | 5 | 15 | 18,000 | 20 |

Table 1 shows that, depending on the number of fields cleared, the payment to be made for the game may increase. The rules determined in the game server also enable the determination of maximum and minimum winning sums. Any winning sums may be determined by utilizing calculus of probability in such a manner that when the chance of winning is low, the sum of winning can be determined higher than it were if the likelihood of winning was higher.

For example, if the player wishes to continue a game by opening three new fields, he selects a continued game 3 from the table and pays €7. Since the minimum sum of winning in this continued game is €50, the player wins €50 in the continued game should he make one hit. Should all thee new fields reveal a mine, the player could win €8,000 in the continued game 3 according to Table 1.

The winning conditions may be determined in the game server to be different for the continued games. The sums obtained from possible winnings may vary depending on how many selections are selectable during each continued game. Depending on the continued game, the winning sums may either decrease or increase. Let us assume for example that a game board comprises 100 selection fields, out of which 20 selection fields cover symbols entitling to a win. The game server may determine a rule for said game board, according to which said game board can be played at maximum as long as 25 selection fields are cleared. Table 2 shows an example of how the magnitude of a maximum winning set in the winning conditions may vary depending on the number of selection fields cleared and the symbols found that entitle to a win.

TABLE 2

| Variation in the number of wins | | |
|---|---|---|
| Fields cleared (No.) | Symbols found (No.) | Maximum jackpot |
| 20 | 20 | 2,000,000 |
| 22 | 20 | 500,000 |
| 25 | 20 | 100,000 |
| 20 | 15 | 50,000 |
| 20 | 10 | 10,000 |
| 20 | 5 | 5,000 |
| 25 | 15 | 15,000 |
| 25 | 10 | 5,000 |
| 25 | 5 | 50 |

For example, if the player wishes to continue playing in a situation wherein 20 selection fields are cleared and 15 symbols found, the game server determines new winning conditions. The probability of finding five symbols out of 80 selection fields is low, whereby the maximum winning sum may be determined larger than previously. This being so, the maximum jackpot may be for instance 1,000,000. The game server may determine alternatives for instance by using known calculus of probability methods. However, modifying winning conditions is always based on a change in the game situation.

Figure 5:
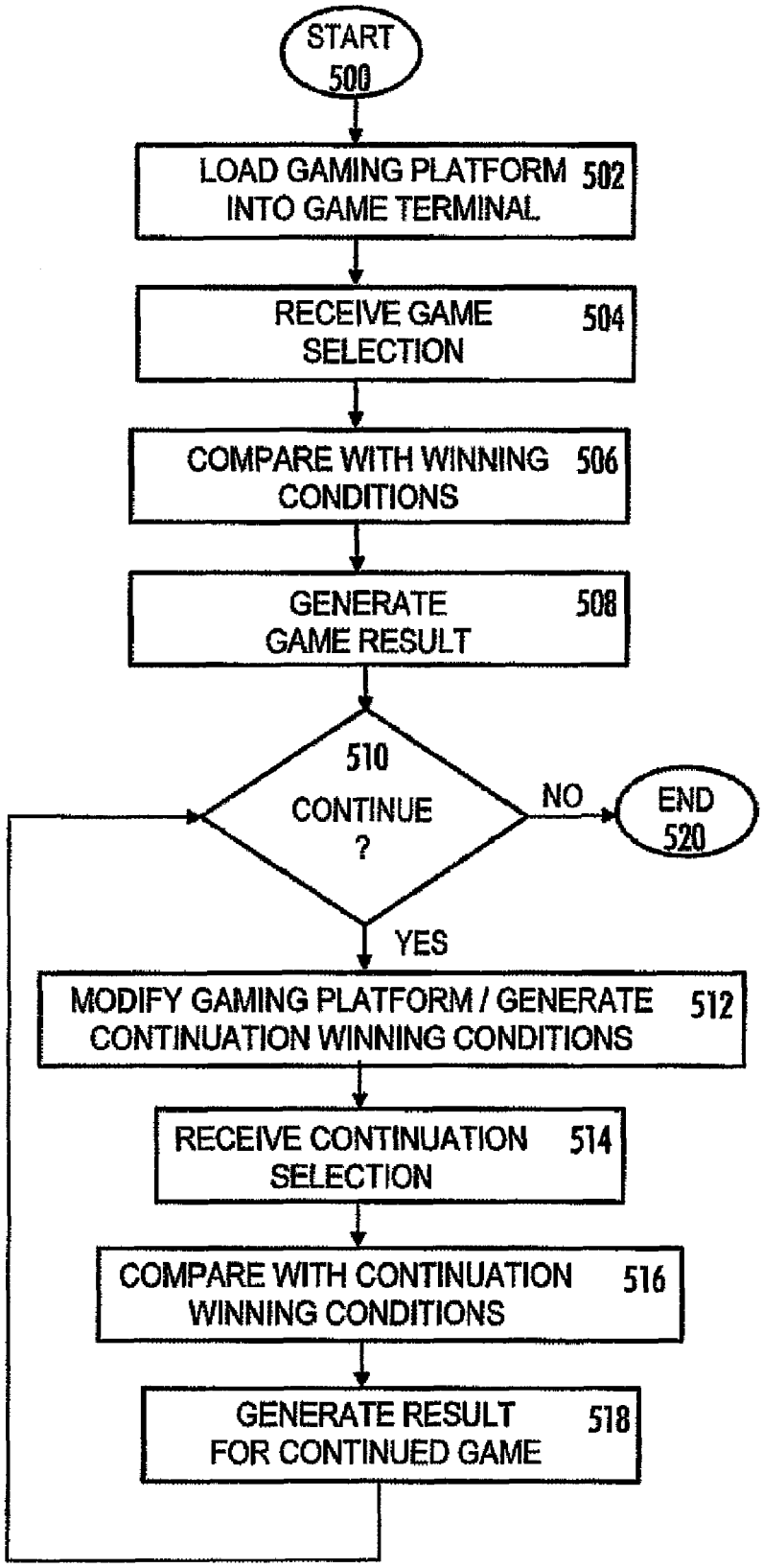
FIG. 5 shows an example of a method of arranging lottery games.

FIG. 5 shows an example of a method of arranging lottery games. The method starts at 500. In 502, a game board is loaded into a game terminal for playing a lottery game. For example, the game board may be based on ready-made selection games and it may be generated in the game server or loaded into the game server from some other device or via a data transmission network, for instance. Winning conditions and prices for each game board may also be generated in the game server. For example, before the game board is loaded, the game server has established a connection with the game terminal, verified the user and credit data regarding the purchaser of the service and received instructions from the game terminal for loading said game board.

In 504, a game selection from the game terminal is received in the game server. The game selection may be the selection of at least one selection field of the game board by the game terminal during the execution of the game, for example. For example, the player of the game has paid for clearing one or more selection fields and, after the selections, has transmitted the selection data to the game server, which detects the selections made.

In 506, a comparison is made between the selections received at the game server and the winning conditions relating to the game board. The game server thus processes for instance the received data about the selection of the selection fields of the game terminal and determines if said selections entitle to wins. In 508, the game result is generated on the basis of the comparison conducted. The game server transmits the game results to the game terminal. However, the transmission of the game results does not necessarily always take place immediately after the selections made by the user. It is possible that a weekly draw, for example, is made for some predetermined games, in which case the result of the game will not become clear before a given day of the week, for example. In this case, the game server may transmit the game result to the game terminal at a later point in time.

In 510, the game server observes the instructions of the game terminal regarding the continuation of the game. If no continuation instructions are received for instance within a predetermined time, the execution of the game is ended in 520. If instructions are received from the game terminal to continue the execution of the game, the process enters step 512, wherein the execution of the lottery game is continued in the same game board.

In 512, the game board is modified on the basis of the game result and the predetermined regulations in such a manner that the selections already made in the game board are deleted from the selections of the game board, and continuation winning conditions regarding the game board are generated on the basis of predetermined regulations. At this stage, the game terminal may make selections and payments concerning the game to be continued. For example, the player may continue the game by paying an additional charge for opening one or more selection fields.

In 514, continuation selections are received at the game server during the execution of the selection game continued, and in 516, the continuation selections are compared with the winning conditions relating to the modified game board. In 518, the game server generates the continued game result on the basis of the comparison conducted, after which the process re-enters 510 to observe further instructions. In an embodiment, the game server can then store the game board in a memory, wherefrom it can later be continued by a user playing with the same or a different user identify.

Figure 6:
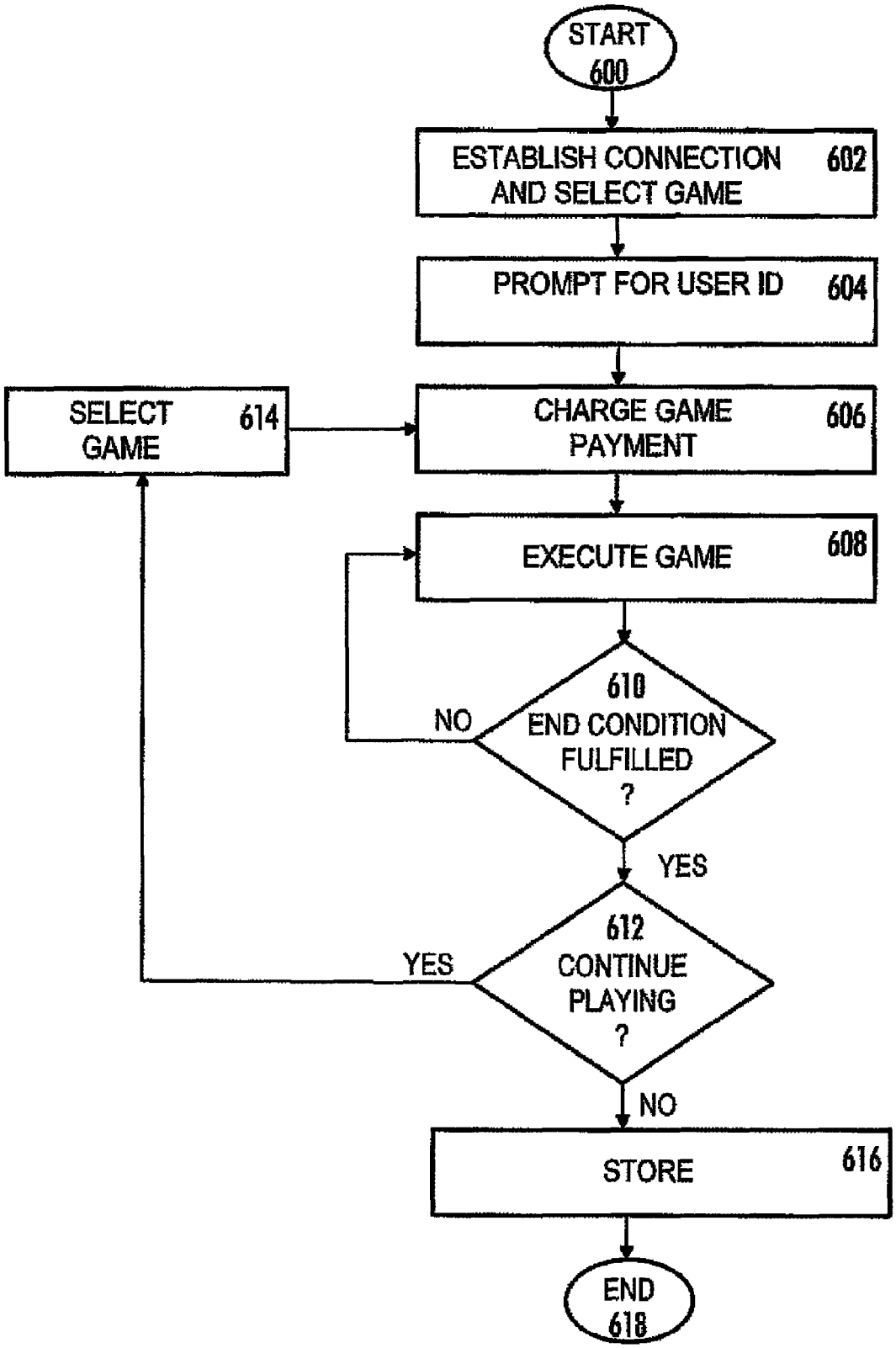
FIG. 6 shows an example of a method of arranging lottery games.

FIG. 6 shows a second example of a method of arranging lottery games. The method starts at 600. In 602, a connection is established and the desired game selected. For example, the game server may offer its service via the Internet in a manner allowing the users to browse game menus by means of a game terminal on an Internet page maintained by the game server. In this case, it is sufficient that the game terminal establishes a connection first only to said Internet page maintained by the game server. When the user of the game terminal has selected the desired game from the Internet page, for example, information thereon is transferred to the game server. The game may be selected either from a database for new games, whereby the game board to be loaded into the game terminal contains for instance only previously unopened selection fields. The game can also be selected from a database for stored games, whereby the game board to be loaded to the game terminal already contains cleared selection fields, which cannot be reselected. In 604, the game server requests for user identities by transmitting a request to the game terminal. In 606, a game payment for said game is charged and in 608, the game is executed.

In 610, the game server observes the fulfillment of the end condition of the game. The end condition may be fulfilled for instance when the number of selections according to the number of paid selections has been made. If the end condition has not been fulfilled, the process remains in step 608. When the end condition is fulfilled, the game server next observes whether playing is continued. For example, if the user wishes to continue the same game he was playing, he inputs information thereon in the game server via the game terminal he is using. If playing is continued, step 614 is entered. In 614, a game is again selected. Herein, game selection means for instance that the user is able to select from a plurality of different alternatives of how to continue the game, which is based on the same game board. After the fulfillment of the previous end condition, the game server has determined new winning conditions and rules regarding one or more executable games to be continued, which are based on the same game board for instance in such a manner that during the execution of the continued game, only those selection fields of the game board are selectable that correspond to the selection fields that were not selected previously. The game server may determine a plurality of different and differently priced alternatives for continuing the game. For example, the user may select to continue the game by paying for the clearing of five new selection fields.

From 614, the process re-enters 606, wherein the game payment is charged, and proceeds then to 608, 610 and 612. If it is observed in 612 that the game is not to be continued, the process proceeds to 616. In 616, the game is stored in the game server. The game server may store the game in a common game database using a given game number, for example, from where the game can be continued by any user. The game server may also store the game in a database reserved under the player's personal user identity in such a manner that only the bearer of said user identity is able to continue playing the game. Such an option for continuing a game can also be made time-dependent in such a manner that if the user has not continued playing the game by a given point in time, the game can be transferred to a common game database. The method ends at 618.

Figure 7:
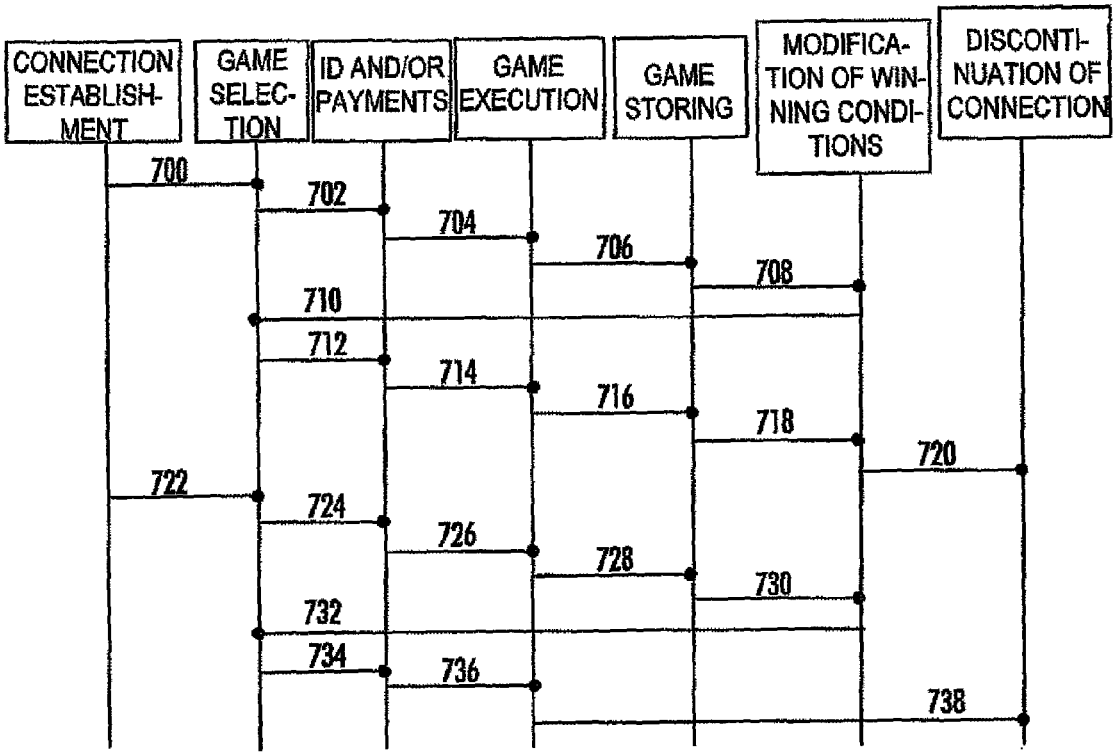
FIG. 7 shows an example of the different method steps in arranging lottery games.

FIG. 7 shows an example of various method steps in arranging lottery games. The game to be played is selected in 700 after a connection is established between the game server and the game terminal. After the game is selected, the player is identified for instance on the basis of user identities, and the payments associated with the selected game are paid in 702. The game is then executed in 704 by making game selections. After the game has been executed, the game may be stored in 706. In addition, the game server modifies the winning conditions and the game board on the basis of the generated game result in 708. The game server informs the game terminal of the following information, for example, at any stage: wins achieved, payment to be charged for clearing the following selection field, maximum winning sum for clearing one selection field, minimum winning sum, payments paid up to the present moment, option to store the game for later use, time available and number of selectable selection fields. The game then continues in 710, wherein the favorite continued game is selected for instance among a plurality of different alternatives, based on the game board modified on the basis of a previous game result in such a manner that only those selections among the selections of the game board are selectable during the execution of the continued game that correspond to the selections of the game board not selected previously.

After the continued game is selected, the payments associated with the game are again paid in 712, and the game is started in 714. The payments charged for the game may have been determined higher than before for the game to be continued, since the computational winning chances have also increased. After the game is over, the game is stored in 716 and the game board and winning conditions relating to one or more games to be continued are modified in 718. After the storage, the connection between the game terminal and the game server may be cut off in 710, if there is no wish to continue playing.

In 722, a connection is again established between the game terminal and the game server, and a game is selected. This time, a different game terminal and/or a different user may be involved than the first time in 700. The game can be selected from stored, previously played games or a completely new game may be started. After game selection, the player is identified for instance on the basis of user identities, and the payments relating to the selected game are paid in 724. For example, the player may select the sum with which he wants to start playing among the different alternatives. The payments to be paid for the game may vary for instance according to how many selection fields the player wishes to select at each time. Then the game is started in 726 for instance by selecting a number of new selections belonging to the game from the remaining selections. After the game is over, the game may be stored in 728. In addition, the game server modifies the winning conditions and the game board on the basis of the generated game result in 730. Playing the game may be resumed in 732.

After the continued game is selected, the payments associated with said game are paid in 734, and the game is started in 736. However, in this example the end condition of the game is fulfilled for a predetermined reason after the game is over. For example, the game end condition may be fulfilled when a given number of selections among the selections of the game board is made or for example when the life time set for the game expires. For example, the game server may have set a six-month time limit for said game, during which any continued games have to be played. After this, any winnings that the user has not otherwise cashed in can be transferred to the player's game account. This way the winning conditions or the game board is not modified after the game is over. However, it is possible to store a game that can no longer be continued, for the user's later browsing. However, herein the method ends in 738 after the game is over in the discontinuation of the connection between the game terminal and the game server.

Figure 8:
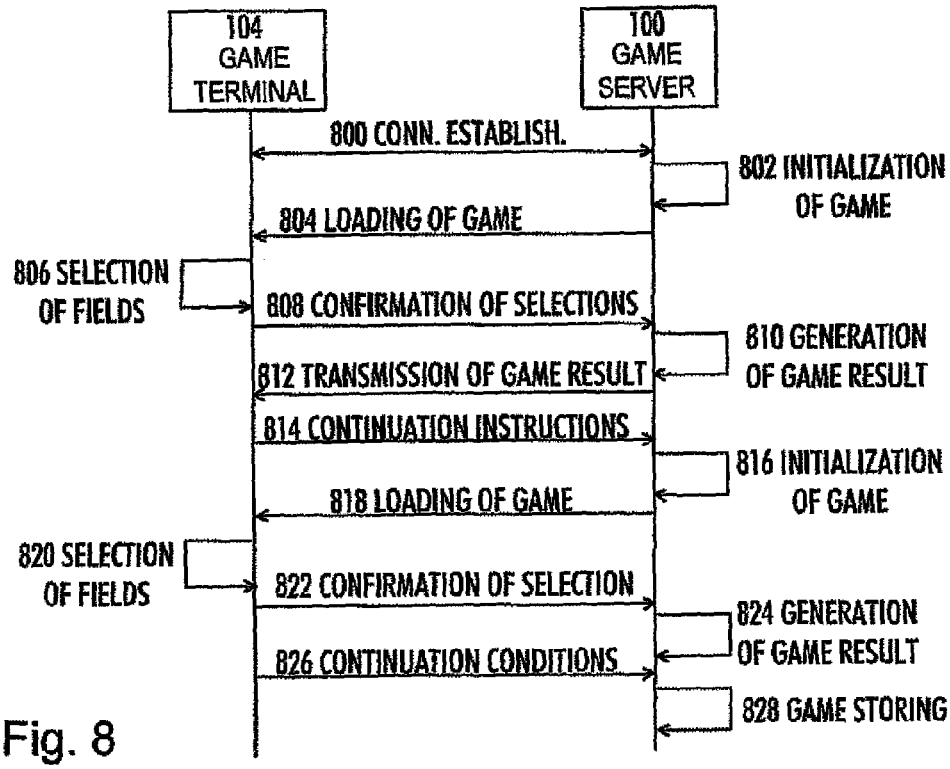
FIG. 8 is a signal sequence diagram illustrating a method of arranging lottery games.

FIG. 8 is a signal sequence diagram illustrating a method of arranging lottery games between a game terminal 104 and a game server 100. In 800, a connection is established. In 802, the game selected is initialized in the game server. In 804, a game board is loaded into the game terminal for execution of the game. In 806, the game terminal selects the selection fields. In 808, the game terminal transmits a confirmation regarding the selection fields selected to the game server. In 810, the game server generates the game result on the bases of the selection of selection fields received. In 812, the game server transmits the game result generated to the game terminal. At the same time, the game server may prompt the game terminal for further instructions.

In 814, the game terminal transmits instructions for continuing the game to the game server. The further instructions may include for instance information indicating that the intention is to continue the game by opening two new selection fields. In 816, the game to be continued is initialized in the game server. In 818, the parameters regarding the game to be continued are loaded into the game terminal. In 820, the selection fields are selected in the game terminal, and in 822, the game terminal transmits a confirmation about the selection fields selected to the game server. In 824, the game server generates a continued game result on the basis of the selection of selection fields received. In 826, the game terminal transmits further instructions to the game server for storing the game. In 828, the game server stores the game for later playing.

Finally, practical examples will be presented of game situations whereto the embodiments described can be applied. In battleships, the object is to find and sink ships of different sizes. The battleships game starts by the user registering as a client to the games of the service provider. This can be achieved by opening a game account and by entering user data, if the user has not previously given his data. In battleships, the winning conditions may be affected for instance by the number of ships found and the size of the found/sunken ship. In battleships, the game board is a 10×10 grid, wherein one ship of the size of four squares, two ships of the size of three squares, three ships of the size of two squares and four ships of the size of one square are hidden. When the game is started, the user is allowed to clear for instance only four squares, of which a basic game payment is charged. Additional payments may be charged for each additional square at each continued game, however, in such a manner that at most 30 squares can be cleared. If the player continues to play over 20 cleared squares, then the amount of a possible maximum win is reduced in a manner comparable to a rake system, for example.

In an exemplary game, the aim is to find 10 symbols among a hundred selection fields in the game board. At the start, 10 fields are cleared and a payment of €5 is made. On the basis of the player's selections, two symbols and 8 empty fields are found. The user then transfers the game to a public game menu to be played by all players. At this stage, a new game number and new winning conditions and prices can be determined for the game. A second player selects the stored game from the game menu, and the game server presents the new winning conditions, for instance that a given sum is won when the third symbol is found. The second player does not find a symbol in the field he cleared, and stores the game again in the game menu. A third player selects the same game. At this stage, there are six cleared fields, two symbols found and four empty fields are cleared. The sum charged for a continued game may now be higher than previously, since the chance of finding symbols has increased. The third player pays the sum charged for clearing one field, €8.50, for example, and does not find a symbol. The player may continue playing by again clearing one field, for which €10 is charged, or by paying a larger sum for clearing more fields. At this stage, a possible jackpot is no longer as high as it was when the game was taken into use for the first time.

As an aspect of the invention there is also provided a computer program product that codes a computer process for processing messages received. The embodiments of the computer process were described in connections with FIGS. 5, 6, 7 and 8.

Although the invention is described herein with reference to the example in accordance with the accompanying drawings, it will be appreciated that the invention is not to be so limited, but the invention may be modified in a variety of ways within the scope of the appended claims.

The invention claimed is:

1. A lottery game server comprising:

a processing unit for controlling the functions of the server;

a data transmission unit coupled to the processing unit for communicating with a game terminal; and a memory unit coupled to the processing unit for storing a game board and winning conditions relating to the game board;

the processing unit comprises a loading module for loading the game board into the game terminal for playing a lottery game, a selection module for receiving a game selection relating to the game board from the game terminal via the data transmission unit, a comparison module for comparing the game selection with the winning conditions relating to the game board, and a result module for generating a game result on the basis of the comparison conducted;

the processing unit further comprises a continuation module for receiving a new payment for continuing the lottery game in the same game board, for deleting the game selection already made in the game board from possible selections of the game board after it is determined that the game result has been generated, and for generating continuation winning conditions relating to the game board on the basis of predetermined rules;

the selection module further receives a continuation selection relating to the game board from the game terminal via the data transmission unit;

the comparison module further compares the continuation selection with the continuation winning conditions;

the result module further generates a continued game result on the basis of the comparison conducted after it is determined that the new payment for continuing the lottery game in the same game board is received by the continuation module; and the memory unit stores the game result and the continued game result, and the loading module loads the game board for continuing the lottery game at a later point in time in the same or a different game terminal, wherein the game board was loaded before the continuation of the lottery game.

2. The server as claimed in claim 1, wherein the processing unit repeats the following steps until an end condition is fulfilled: the execution of the lottery game is continued in the same game board on the basis of the previous, stored, continued game result; and the next continued game result is generated on the basis of the continuation selections made and the continuation winning conditions generated.

3. The server as claimed in claim 2, wherein the processing unit detects that the end condition is fulfilled on the basis of at least one of the fulfillment of predetermined marginal terms, the expiration of time limits set, the realization of a predetermined game result and the number of selections in the game board selectable at each particular time.

4. The server as claimed in claim 1, wherein the processing unit further determines the winning conditions and the continuation winning conditions relating to the lottery game executed on the basis of the number of selections selectable in the game board.

5. The server as claimed in claim 4, wherein the processing unit is arranged to determine the winning conditions and the continuation winning conditions relating to the lottery game by the use of calculus of probability.

6. The server as claimed in claim 1, wherein the game result and the continued game result comprise one or more of the following: information on the winning sum, information on the right to continue a following lottery game based on the game result/continued game result generated, information on prices of the lottery games to be optionally continued on the basis of the lottery game executed, information on possible winning sums of the lottery games to be continued.

7. The server as claimed in claim 1, wherein the processing unit is further arranged to receive user-identifying information from the game terminal via the data transmission unit.

8. The server as claimed in claim 7, wherein the processing unit is arranged to reserve the right to continue playing in a modified game board only to a given user on the basis of the user-identifying information.

9. The server as claimed in claim 7, wherein the processing unit is arranged to reserve the right to continue playing in a modified game board to anyone irrespective of the user-identifying information received.

10. A method of arranging lottery games, the method comprising:

loading a game board into a gaming terminal for playing a lottery game;

receiving a game selection relating to the game board via a data transmission unit from a game terminal;

comparing the game selection with winning conditions relating to the game board;

generating a game result on the basis of the comparison conducted;

deleting the game selection already made in the game board from possible selections of the game board after it is determined that the game result has been generated, and then generating continuation winning conditions relating to the game board on the basis of predetermined rules;

receiving a continuation selection relating to the game board via the data transmission unit from the game terminal;

comparing the continuation selection with the continuation winning conditions;

generating the continued game result on the basis of the comparison conducted after it is determined that a new payment for continuing the lottery game in the same game board is received;

storing the game result and the continued game result in a game server; and loading the game board for continuing the lottery game at a later point in time in the same or a different game terminal wherein the game board was loaded before the continuation of the lottery game.

11. The method as claimed in claim 10, further comprising: repeating the following steps in the method until an end condition is fulfilled: continuing the execution of the lottery game in the same game board on the basis of the previous, stored continued game result; and generating the next continued game result on the basis of the continuation selections made and the continuation winning conditions generated.

12. The method as claimed in claim 11, further comprising: detecting the end condition as fulfilled in the game server on the basis of at least one of the fulfillment of predetermined marginal terms, the expiration of time limits set, the realization of a predetermined game result and the number of selections in the game board selectable at each particular time.

13. The method as claimed in claim 10, further comprising: determining the winning conditions and the continuation winning conditions relating to the lottery game executed on the basis of the number of selections selectable in the game board.

14. The method as claimed in claim 13, further comprising: determining the winning conditions and the continuation winning conditions relating to the lottery game by the use of calculus of probability.

15. The method as claimed in claim 10, wherein the game result and the continued game result comprise one or more of the following: information on the winning sum, information on the right to continue a following lottery game based on the game result/continued game result generated, information on prices of the lottery games to be optionally continued on the basis of the lottery game executed, information on possible winning sums of the lottery games to be continued.

16. The method as claimed in claim 10, further comprising: receiving user-identifying information from the game terminal via the data transmission unit.

17. The method as claimed in claim 16, further comprising: reserving the right to continue playing in a modified game board only to a given user on the basis of the user-identifying information.

18. The method as claimed in claim 16, further comprising: reserving the right to continue playing in a modified game board to anyone irrespective of the user-identifying information received.

19. The method as claimed in claim 10, wherein the winning conditions and the continuation are mutually different.

20. A non-transitory computer-readable medium containing a computer program product comprising computer-executable instructions for arranging lottery games, the computer program product comprising computer-executable instructions for:

loading a game board into a game terminal for playing a lottery game;

receiving a game selection relating to the game board via a data transmission unit from a game terminal;

comparing the game selection with winning conditions relating to the game board;

generating the game result on the basis of the comparison conducted;

deleting the game selection already made in the game board from possible selections of the game board after it is determined that the game result has been generated, and then generating continuation winning conditions relating to the game board on the basis of predetermined rules;

receiving a continuation selection relating to the game board via the data transmission unit from the game terminal;

comparing the continuation selection with the continuation winning conditions;

generating the continued game result on the basis of the comparison conducted after it is determined that a new payment for continuing the lottery game in the same game board is received;

storing the game result and the continued game result in a game server; and loading the game board for continuing the lottery game at a later point in time in the same or a different game terminal wherein the game board was loaded before the continuation of the lottery game.

21. The server as claimed in claim 1, wherein in a case where the continued game result is generated, the same game board with deletion of the game selection already made in the game board is kept on the gaming terminal from a point after the game result is generated but before receiving the continuation selection, until after the continued game result is generated.

22. The method as claimed in claim 10, wherein in a case where the continued game result is generated, the same game board with deletion of the game selection already made in the game board is kept on the gaming terminal from a point after the game result is generated but before receiving the continuation selection, until after the continued game result is generated.

23. The non-transitory computer-readable medium as claimed in claim 20, wherein in a case where the continued game result is generated, the same game board with deletion of the game selection already made in the game board is kept on the gaming terminal from a point after the game result is generated but before receiving the continuation selection, until after the continued game result is generated.

* * * * *